US006192909B1

(12) United States Patent
Strausser

(10) Patent No.: US 6,192,909 B1
(45) Date of Patent: Feb. 27, 2001

(54) COLLAPSIBLE ALL-TERRAIN SHELTER AND FRAME

(76) Inventor: Matthew Strausser, 5462 Carew St., Houston, TX (US) 77096

( * ) Notice: Subject to any disclaimer, the term of this patent is extended or adjusted under 35 U.S.C. 154(b) by 0 days.

(21) Appl. No.: 09/340,986

(22) Filed: Jun. 28, 1999

(51) Int. Cl.[7] ..... E04H 15/36

(52) U.S. Cl. ..... 135/137; 135/95; 135/116; 5/113; 224/154

(58) Field of Search ..... 135/95, 116, 137; 224/153, 154; 5/111, 113, 121

(56) References Cited

U.S. PATENT DOCUMENTS

| | | | | |
|---|---|---|---|---|
| 979,037 | | 12/1910 | Searle . | |
| 1,259,080 | | 3/1918 | Chittim . | |
| 1,395,158 | | 10/1921 | Smith . | |
| 1,561,797 | | 11/1925 | Rumpel . | |
| 1,621,464 | | 3/1927 | Fortin . | |
| 1,985,694 | | 12/1934 | Rosenbaum . | |
| 2,841,803 | | 7/1958 | Bodling . | |
| 3,278,953 | | 10/1966 | Willis . | |
| 3,584,322 | | 6/1971 | McDougall . | |
| 3,601,825 | * | 8/1971 | Moorhead | 5/113 |
| 3,619,827 | | 11/1971 | Mackenzie . | |
| 3,848,279 | | 11/1974 | Ispen . | |
| 3,971,495 | | 7/1976 | Velazquez . | |
| 5,210,888 | * | 5/1993 | Canfield | 5/113 |
| 5,449,014 | | 9/1995 | Yan-ho . | |
| 5,507,046 | * | 4/1996 | Taylor | 5/414 |

* cited by examiner

*Primary Examiner*—Carl D. Friedman
*Assistant Examiner*—Beth Stephan
(74) *Attorney, Agent, or Firm*—Vinson & Elkins L.L.P.

(57) ABSTRACT

A lightweight base frame including connectable frame members. The members are advantageously extensible. A thicker central portion of each member advantageously provides sturdiness and stability to the base frame. A cloth is suspended taunt across the frame. Once assembled, the base frame and cloth form the floor of the shelter as well as a cot. Attachable adjustable-height legs with high-traction feet further enable the user to lie comfortably and level above grade on a wide range of ground surfaces, even on rugged or sloping terrain. In a preferred embodiment, built-in leveling bubbles in the end and side frame components help adjust the base frame to level. A shelter primarily in the nature of a tent is then erected up from the base frame.

22 Claims, 10 Drawing Sheets

COLLAPSIBLE ALL-TERRAIN SHELTER AND FRAME

TECHNICAL FIELD OF THE INVENTION

This invention relates generally to the temporary shelter, outdoor recreation and camping arts, and more specifically to a collapsible all-terrain shelter and frame for use in such environments.

BACKGROUND OF THE INVENTION

Generally, tents and similar outdoor shelters are restricted to being placed and anchored to the ground. That is, the character of the floor in such structures is dictated by the underlying ground. Although modem technology provides tents that are relatively inexpensive and lightweight compared to tents of a decade ago, these tents do not protect the occupant(s) from the discomforts of wet or rocky ground. In addition, even the most modem tents provide little comfort on sloping ground.

To be sure, a cot provides to the relief to the user regarding wet or rocky ground. However, the cot is of no aid to the user when dealing with sloping terrain. Furthermore, commercial one-camper tents are too small to comfortably enclose a cot. Similarly, two-camper tents are too small to hold two cots. Just taking the one-camper instance, even if the tent was large enough to comfortably accommodate the cot, the bulk and weight of the separate tent and cot would preclude them from being easily carried by the camper, let alone fitting into the camper's backpack.

There is, therefore, a need for an apparatus that provides the comfort and safety of a cot within a shelter. Such an inventive apparatus will be level and stable on soft, rough or sloping terrain, will have the structural design to comfortably accommodate one or more sleeping adults, will require no special training or tools to assemble and disassemble, will be well-ventilated, will provide ample storage, and will be able to be carried inside a personal backpack.

SUMMARY OF THE INVENTION

These and other objects, features and technical advantages are achieved by my invention, which comprises a lightweight base frame including connectable frame members. The members are advantageously extensible. A thicker central portion of each member advantageously provides sturdiness and stability to the base frame.

After extending the frame members, the user can easily connect them by locking their ends into rounded corner brackets to assemble the base frame. A cloth is suspended taunt across the frame. Once assembled, the base frame and cloth form the floor of the shelter as well as a cot. Attachable adjustable-height legs with high-traction feet further enable the user to lie comfortably and level above grade on a wide range of ground surfaces, even on rugged or sloping terrain. In a preferred embodiment, built-in leveling bubbles in the end and side frame components help adjust the base frame to level.

A shelter primarily in the nature of a tent is then erected up from the base frame. The shelter comprises further advantageous features as will be described in detail later on.

It is therefore a technical advantage of the present invention for the inventive shelter and cot to be collapsible and portable. For easy storage and transport, the frame sides and ends advantageously extend from their centers.

A further technical advantage is that the invention is lightweight, easy to assemble, and durable. In a preferred embodiment, the shelter canopy is advantageously constructed from 70-denier ripstop nylon supported by crossed flexible hoop arches constructed from plastic or fiberglass.

Another technical advantage is that in most cases, the invention obviates the need for ground stakes and guy ropes. Except in the most severe conditions, the inventive assembly is freestanding and does not need to be stabilized by anchors to the ground. This freestanding feature frees the user from carrying tools, ground stakes and rope unless severe conditions are anticipated.

A still further technical advantage is that the invention is adaptable to alternative service. In appropriate conditions, the invention may be used as a traditional "on-the-ground" shelter. This can be accomplished by using the canopy and adjustable hoop arches without attaching them to the base frame and adjustable-height legs. Alternatively, in a medical emergency, the base frame and the unsupported canopy can be used as a stretcher.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
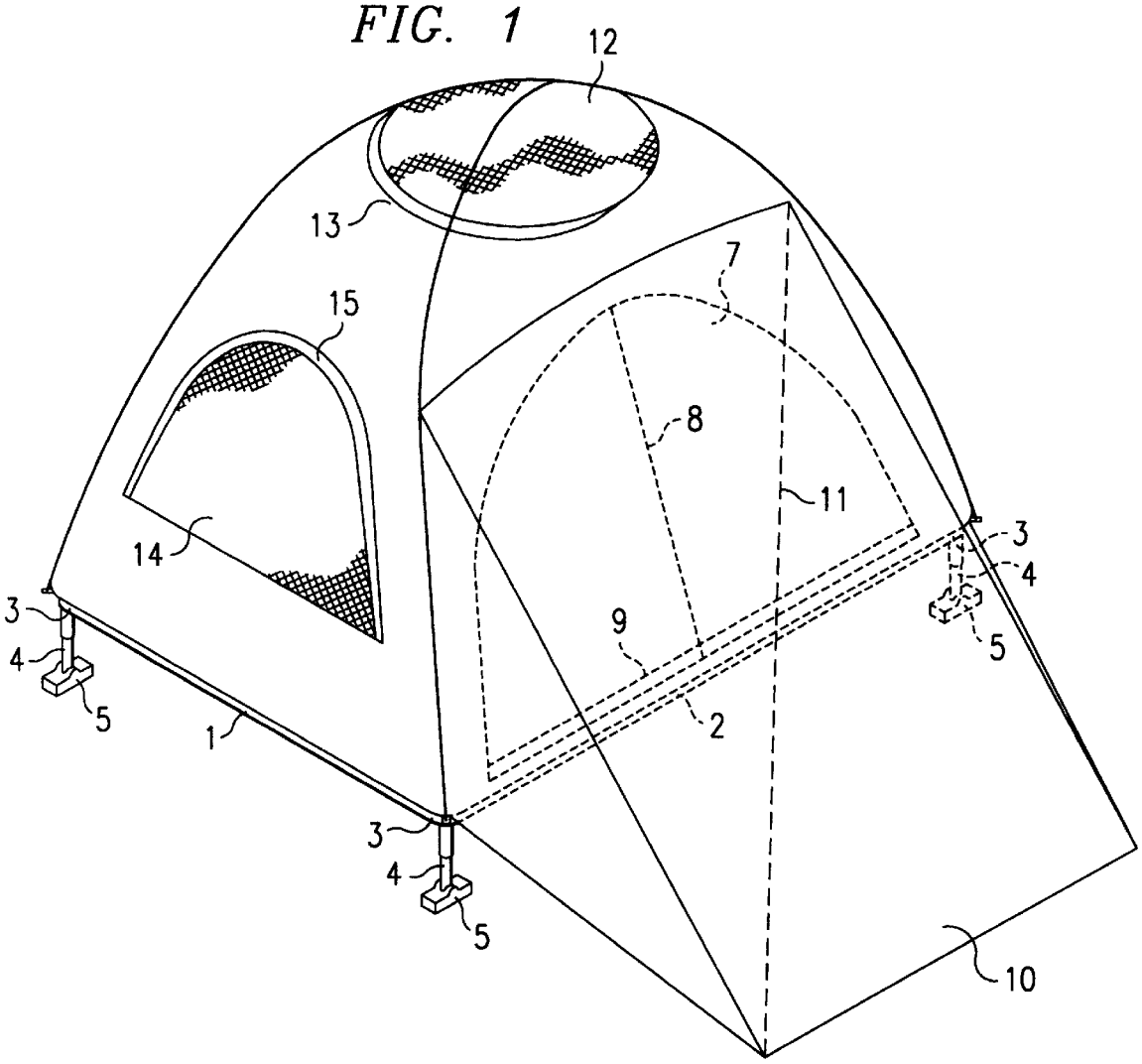
FIG. 1 shows a perspective view of the inventive shelter in a one-user embodiment.
Figure 2:
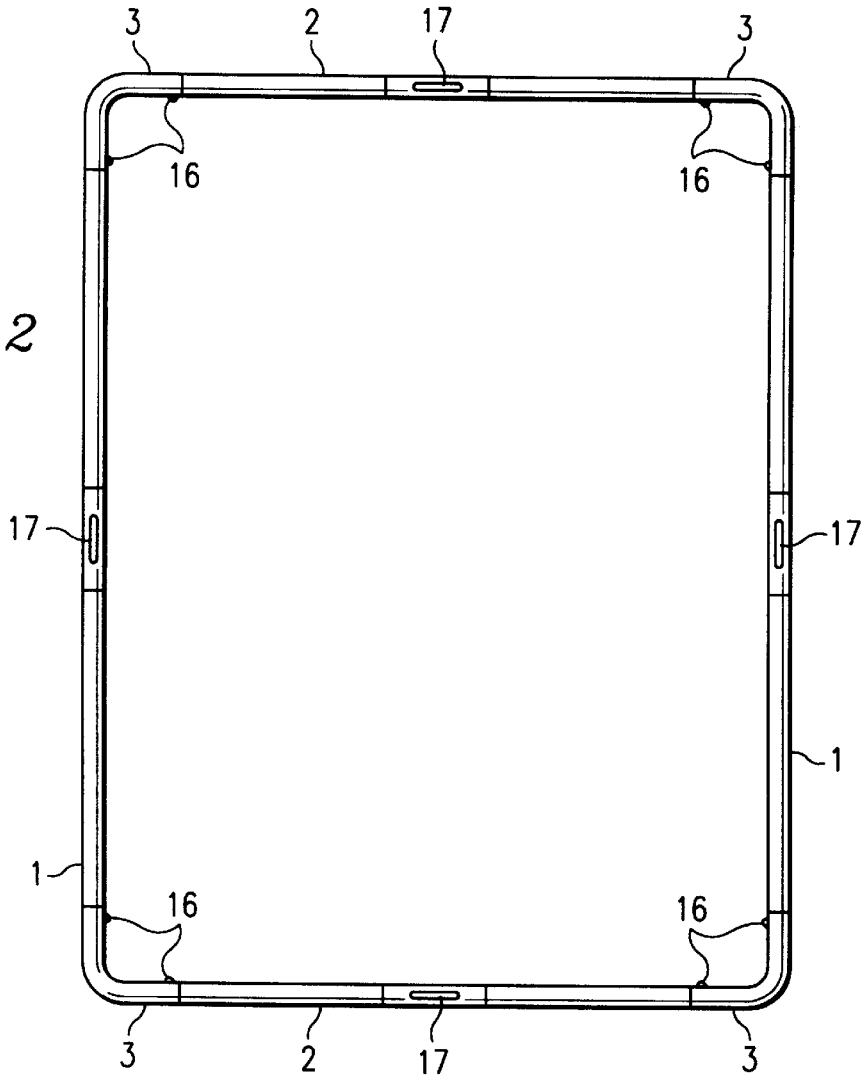
FIG. 2 shows a top view of the collapsible base frame in a one-user embodiment.
Figure 3:
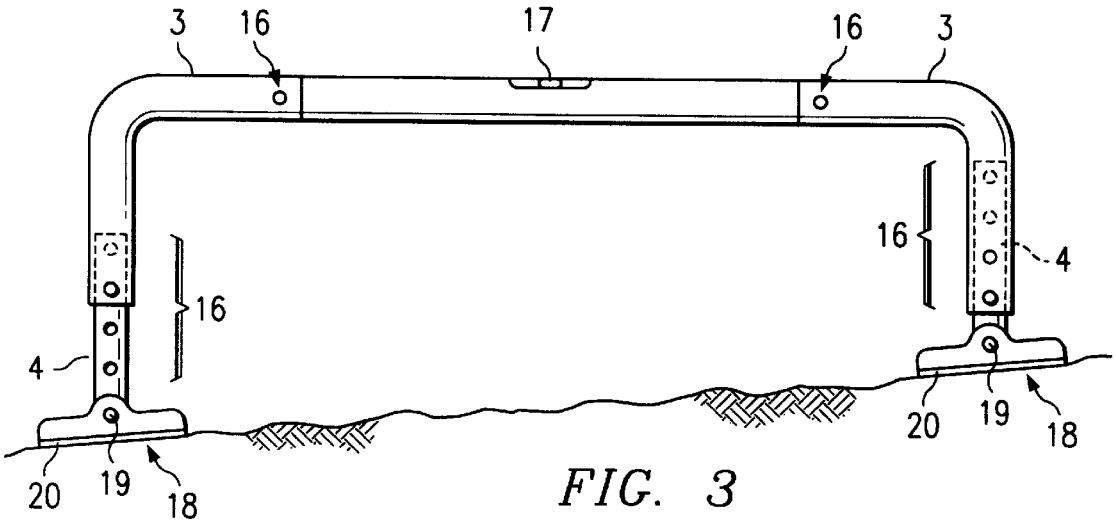
FIG. 3 shows an elevation view of FIG. 2 and illustrates the adjustable height legs.

FIGS. 1, 2 and 3 illustrate a perspective view of a first embodiment operable for a single user. A substantially planar base frame comprises two extensible side frame components 1 and two extensible end frame components 2. The side frame components and end frame components extend and fit into rounded corner brackets 3. An independently adjustable height leg 4 connects to each of the lower sections of the four rounded corner brackets such that the legs extend in a common direction orthogonal to the plane of the planar base frame. The lower end of each adjustable height leg is fitted with a pivoting foot 5 that stabilizes the apparatus on soft or uneven terrain. Foot 5 is advantageously high-traction.

It will be understood that the frame components, legs and feet are advantageously constructed from a lightweight but structurally strong material such as aluminum or a fiber-reinforced plastic composite, for example. The invention is not limited in this regard, however. Moreover, although FIGS. 1 through 16 herein depict embodiments in which four corner brackets 3 are employed, it will be appreciated that other embodiments of the invention may employ any sized polygonal frame having at least three corner brackets and at least three adjustable legs.

Although not illustrated, it will be further appreciated that frame components 1, 2 may also advantageously be thicker in a central portion to provide additional sturdiness and stability to the assembled frame.

With further reference to FIG. 1, cover 7 is a double layer flap consisting of a screen mesh interior flap and a waterproof nylon exterior flap. Both of the flaps advantageously have a vertical zipper 8 and a horizontal zipper 9 running the length of the base of the opening. These zippers provide easy access and secure the front entrance flaps. When opened, one or both flaps can be rolled back and held in place by loop ropes.

Optional front vestibule 10 provides additional undercover storage by extending the vestibule canopy to the ground and securing it to the ground with, for example, ground stakes. The canopy is advantageously equipped with a diagonal zipper opening 11 for easy access. Note, however, that if optional front vestibule 10 is used, the inventive shelter will no longer be free-standing.

FIG. 1 also shows a dome mesh screen 12 with a protective rain flap 13 that provides ventilation. The protective rain flap 13, when not in use, can be rolled and tied for storage, as depicted in FIG. 1. Cross ventilation is achieved by side screened windows 14 equipped with horizontal and vertical flaps 15 to cover them during cold or wet weather. (The protective flap is shown to be rolled back in FIG. 1.) Additional cross ventilation can be achieved by opening the rear screen window 30 (see FIG. 7) and using the front screen opening 7.

Figure 12:
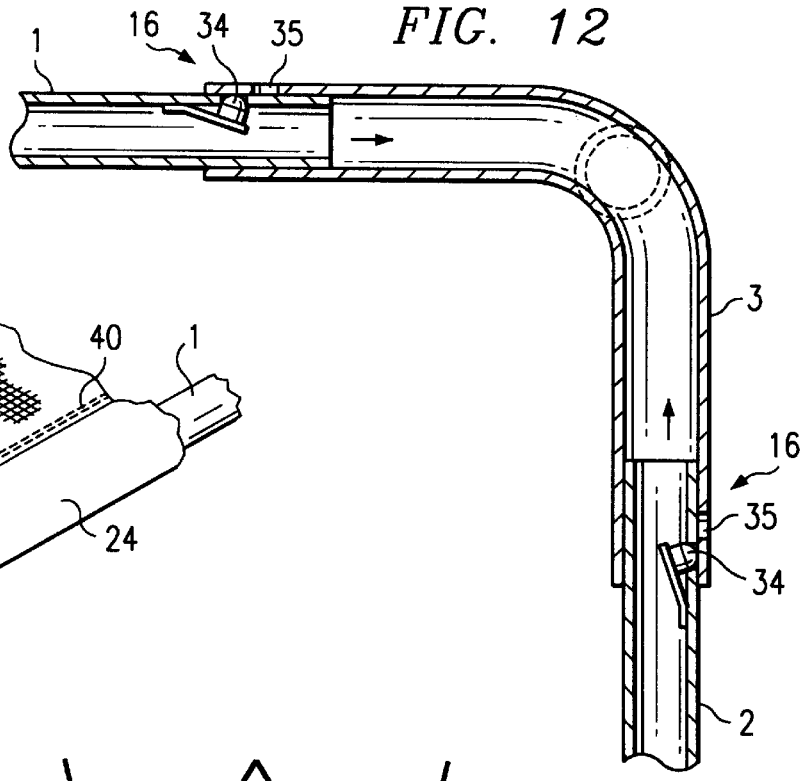
FIG. 12 shows a detailed view of the base frame locking button assembly in a preferred embodiment.
Figure 13:
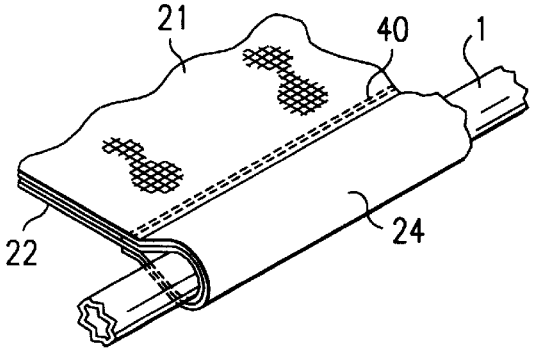
FIGS. 13 shows a detailed view of attachment by the floor sleeves to the base frame in a preferred embodiment.

Next, to examine the base frame in a one-user embodiment in more detail, refer to FIG. 2, which is a top view of the collapsible base frame. Assembling the base frame is begun by extending the side frame components 1 and end frame components 2. All of the frame components advantageously extend from the center and this extensible mechanism allows the base frame components to be of a manageable size for storage and transport. Once the user has extended the base frame components 1 and 2 and has fed them through the tent floor sleeves, the base frame assembly is completed by inserting the component ends into the horizontal openings of each of the rounded corner brackets 3. Locking button 16 assembly secures the side 1 and end 2 components in place. Refer to FIG. 12 for a detailed illustration of the base frame locking button assembly 16, in which a spring loaded hemisphere 34 engages with 35 at the selected adjustable length, as is known in the art.

Referring now to FIG. 3, it will be seen that leveling of the apparatus is accomplished by adjusting the height of each adjustable height leg 4 by pulling or pushing the leg into the bottom portion of the rounded corner bracket 3 the desired distance such that the frame sets level on the terrain. Leg 4 is then advantageously locked into corner bracket 3 using locking button mechanism 16 as described above with reference to FIG. 12. Leveling bubbles 17 built into the end frame components 1 and the side frame components 2 further advantageously aid in leveling the shelter on sloping terrain.

With continuing reference to FIG. 3, the shelter is further leveled and secured by placing the movable foot 18 into a desired position. A hinge mechanism 19 on the bottom of the adjustable height leg allows the foot to be pivoted through a wide range of angles. Furthermore, the movable foot is wide so to provide stability in soggy ground, and is equipped with a high-traction surface 20, such as a rubber tread, for improved traction on sloping surfaces.

Figure 4:
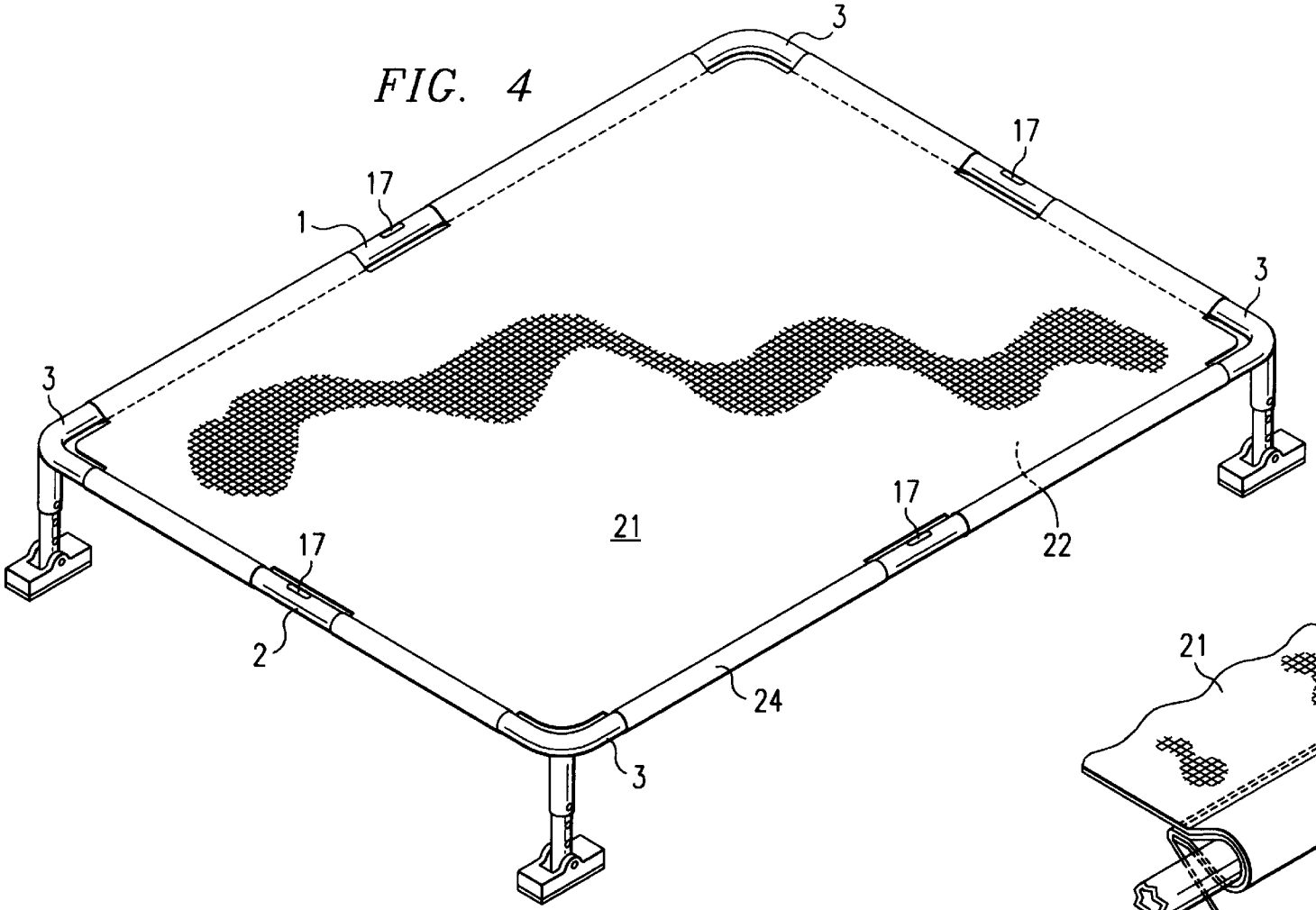
FIG. 4 is a perspective view of the two ply floor surrounded by the base frame assembly.

FIG. 4 illustrates a perspective view of the base frame assembly and the shelter floor surface. The floor surface is created when the camper feeds the base frame components 1 and 2 through the tent floor sleeves 24. As further illustrated on FIG. 13, the floor sleeves 24 are constructed from layering and sewing the edges of the upper ply 21 and the lower ply 22 of the floor so that the frame components 1 and 2 can be fed through next to seam 40.

Figure 5:
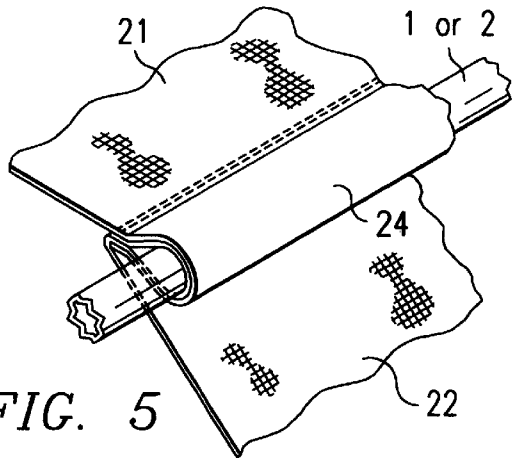
FIG. 5 is an exploded view of the two-ply floor.

FIG. 5 depicts the two plys 21, 22 of the floor separated for the purposes of illustration. The floor is comprised of an upper ply floor 21 and a lower ply floor 22 sewn together along the outer edge. In a preferred embodiment, the upper ply floor 21 comprises 1000 denier fine mesh polyester pulled tightly across the base frame. The bottom ply 22 of the floor is constructed from 70-denier ripstop nylon that adds strength to the floor and insulation from wet and cold.

Figure 6:
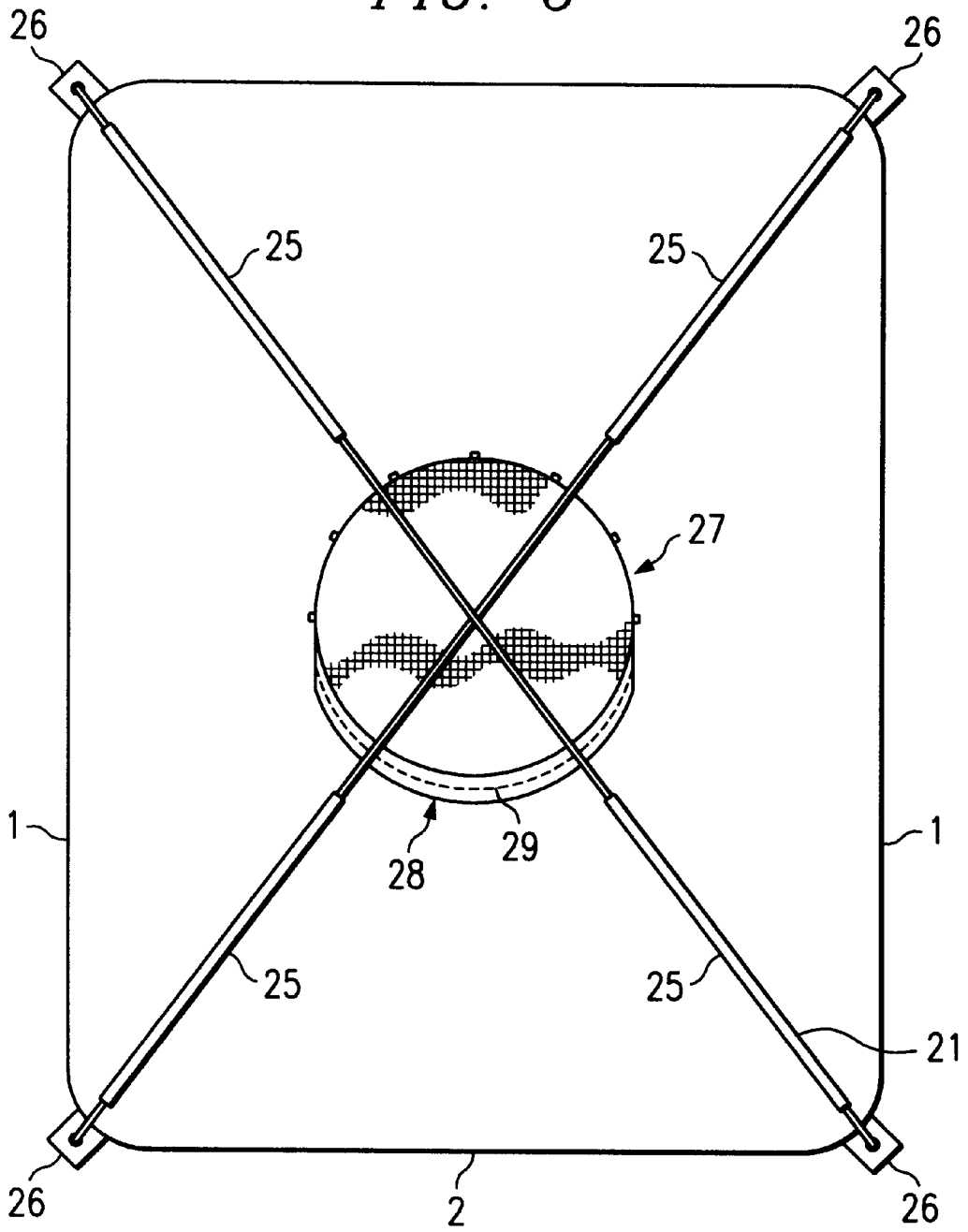
FIG. 6 shows a top view of the assembly in a one-user embodiment.
Figure 14A:
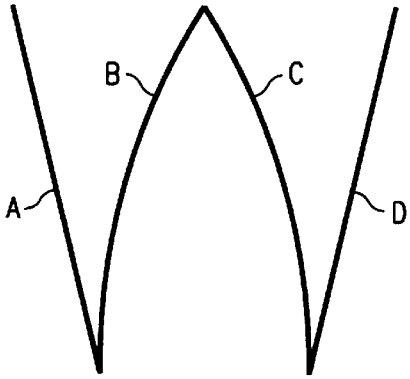
FIGS. 14A and 14B show a detailed side views of the collapsible hoop arches in the folded and extended positions.
Figure 14B:
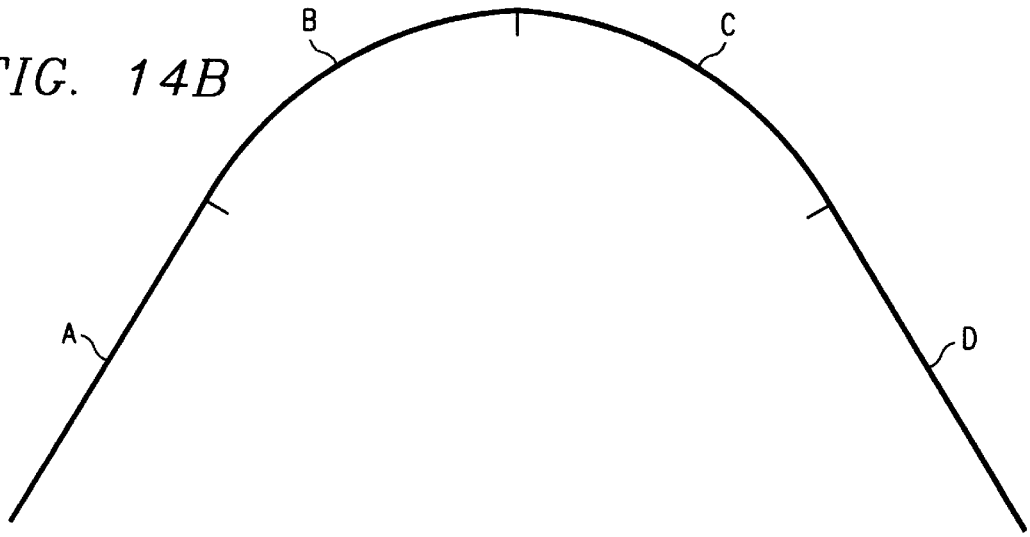
Figure 15:
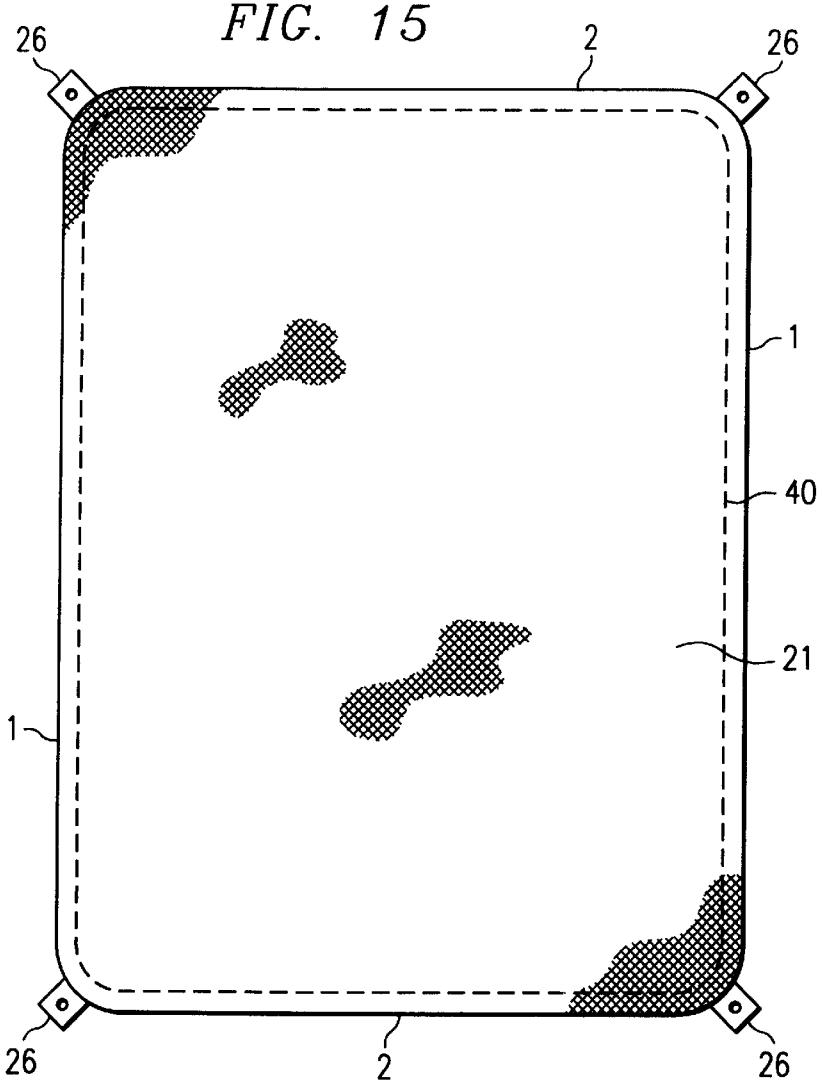
FIG. 15 illustrates a preferred embodiment of the floor having corner grommets to receive the hoop arch ends.

FIG. 6 depicts a top view of the shelter. Collapsible hoop arches are fully extended and are fed through the canopy tent sleeves 25 sewn into the canopy of the shelter. Refer to FIGS. 14A and 14B for folded and extended details of the collapsible hoop arches. FIGS. 14A and 14B illustrate the collapsible hoop arches as provided in four exemplary sections A, B, C and D, as may be found in the art. Returning to FIG. 6. A dome shape results by bending the hoop arches and inserting the hoop arch ends into the grommets 26 sewn into the floor 21 and 22 of the shelter. Refer to FIG. 15 for a detailed illustration of a preferred embodiment of the grommets.

Figure 16:
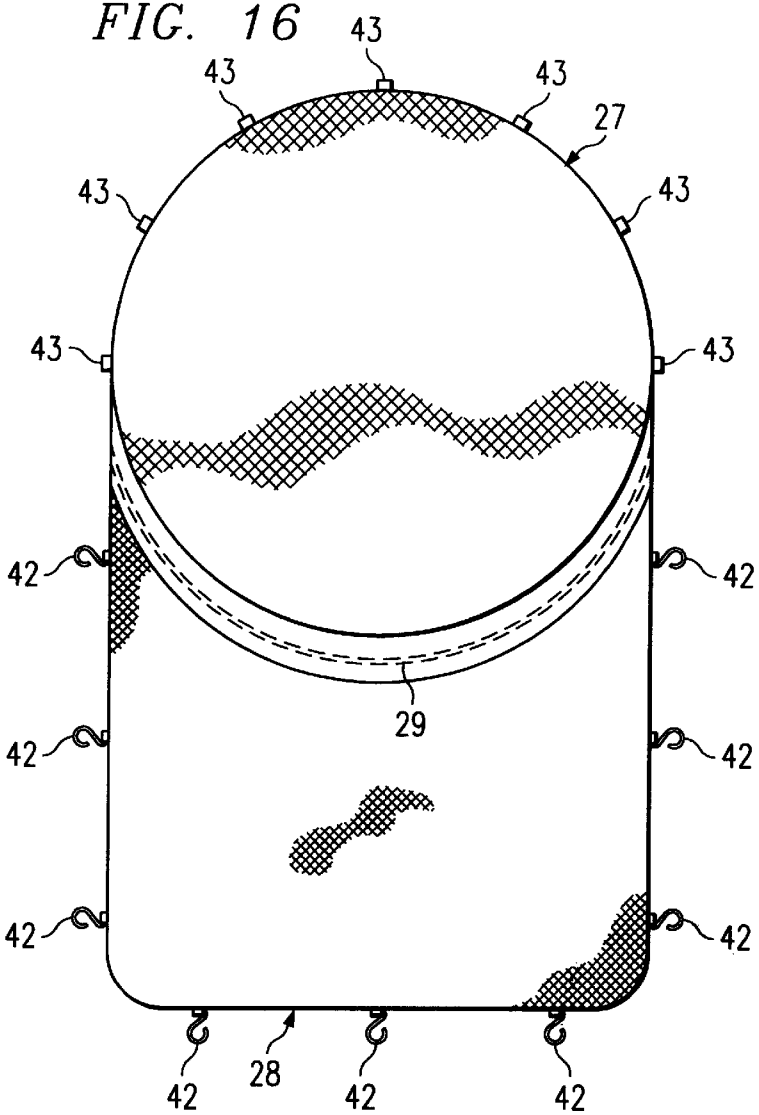
FIG. 16 shows a detailed top view of the screen mesh dome in a preferred embodiment.

FIG. 6 also depicts the screen mesh dome 27. Advantageously, the shelter is equipped with an attached rain flap 28 and zipper pocket 29. In FIG. 6, the rain flap is shown to be rolled and stored. The rain flap can be easily unrolled from the zipper pocket and secured into place by a series of snaps and hooks in case of wet or cold weather. FIG. 16 provides a more detailed illustration of the dome hook 42 and hook ring 43 arrangement.

Figure 7:
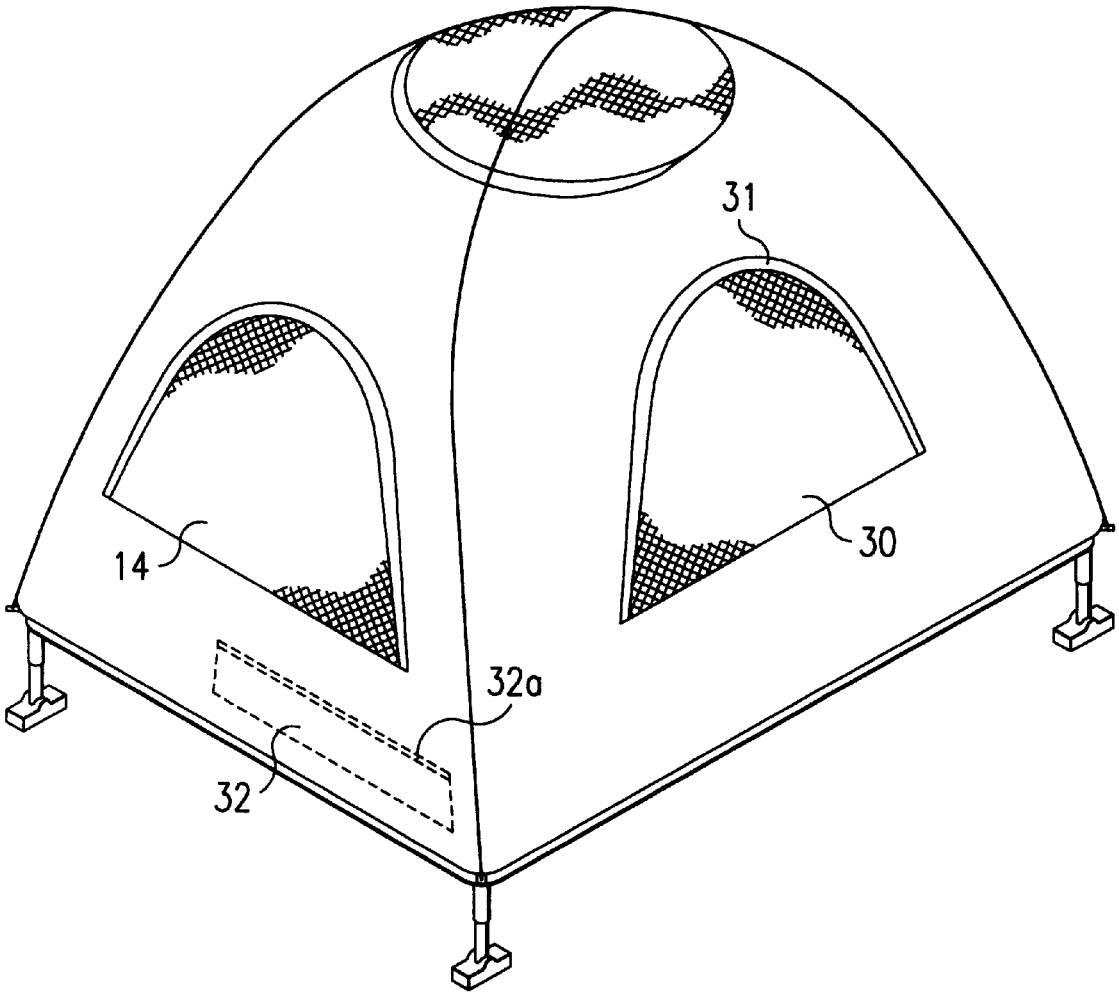
FIG. 7 shows a perspective view of the one-user embodiment from the rear.

FIG. 7 depicts a rear view of the one-user embodiment. Rear window 30 provides ventilation when the outer entrance flap is rolled back leaving the inner flap (screen) in place. Rear window 30 is equipped with an attached rain cover 31 that can be rolled up along the edge of the window when not in use. In FIG. 7, the rain flap is shown rolled and stored.

FIG. 7 also depicts interior side storage compartments 32 that are sewn into the tent canopy on both sides of the interior. The top of the compartment contains a zipper opening 32*a* for easy access.

Figure 8:
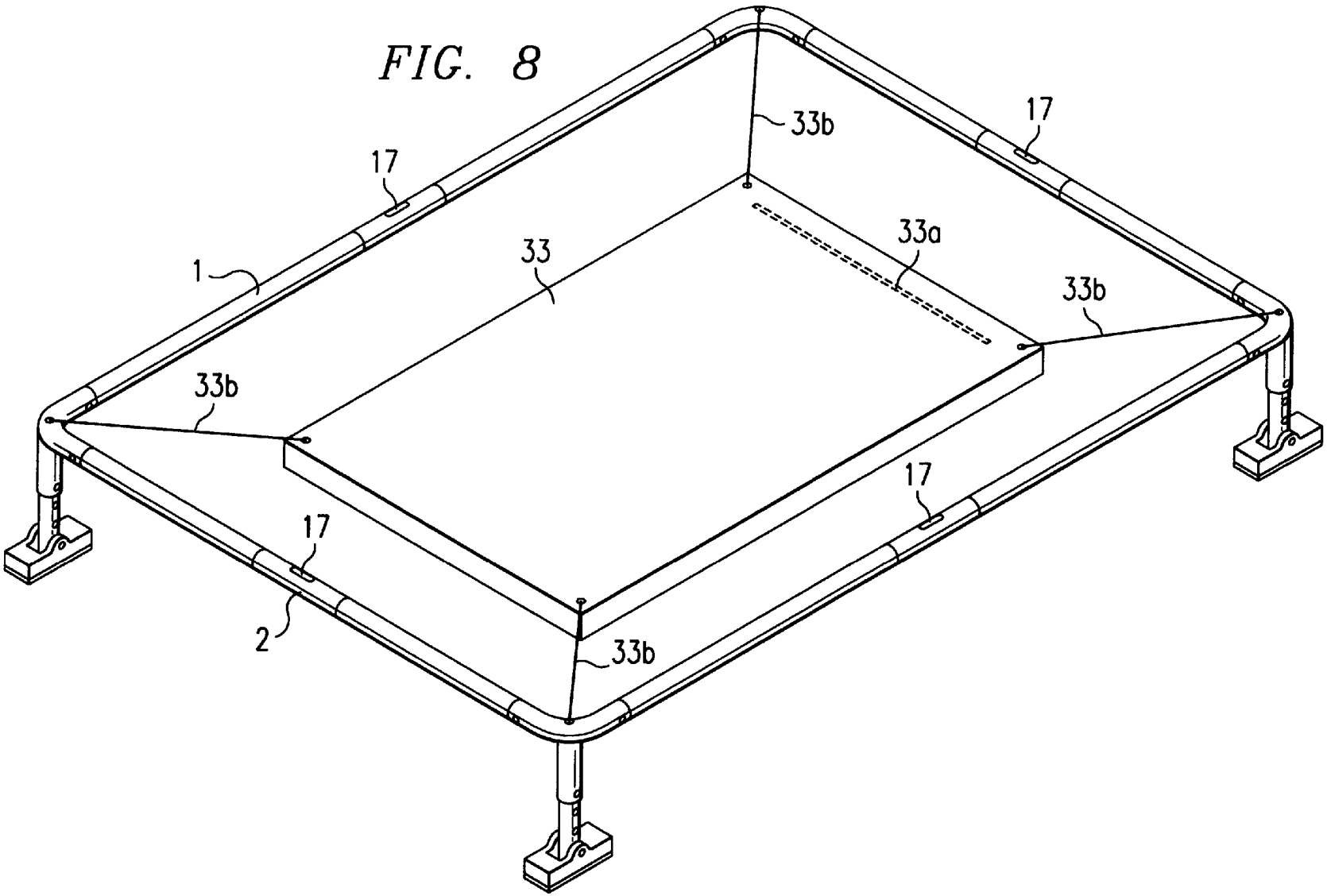
FIG. 8 illustrates the optional cellar storage compartment.

FIG. 8 shows the optional additional storage available under the floor 21/22. FIG. 8 illustrates this storage with the floor of the shelter removed, for clarity of illustration. Cellar storage compartment 33 consists of a removable nylon bag with a zipper opening 33*a* equipped with binding lines 33*b* that secure the storage compartment to the rounded corner brackets. The binding lines allow the cellar storage compartment to be suspended on the underside of the shelter floor.

Figure 9:
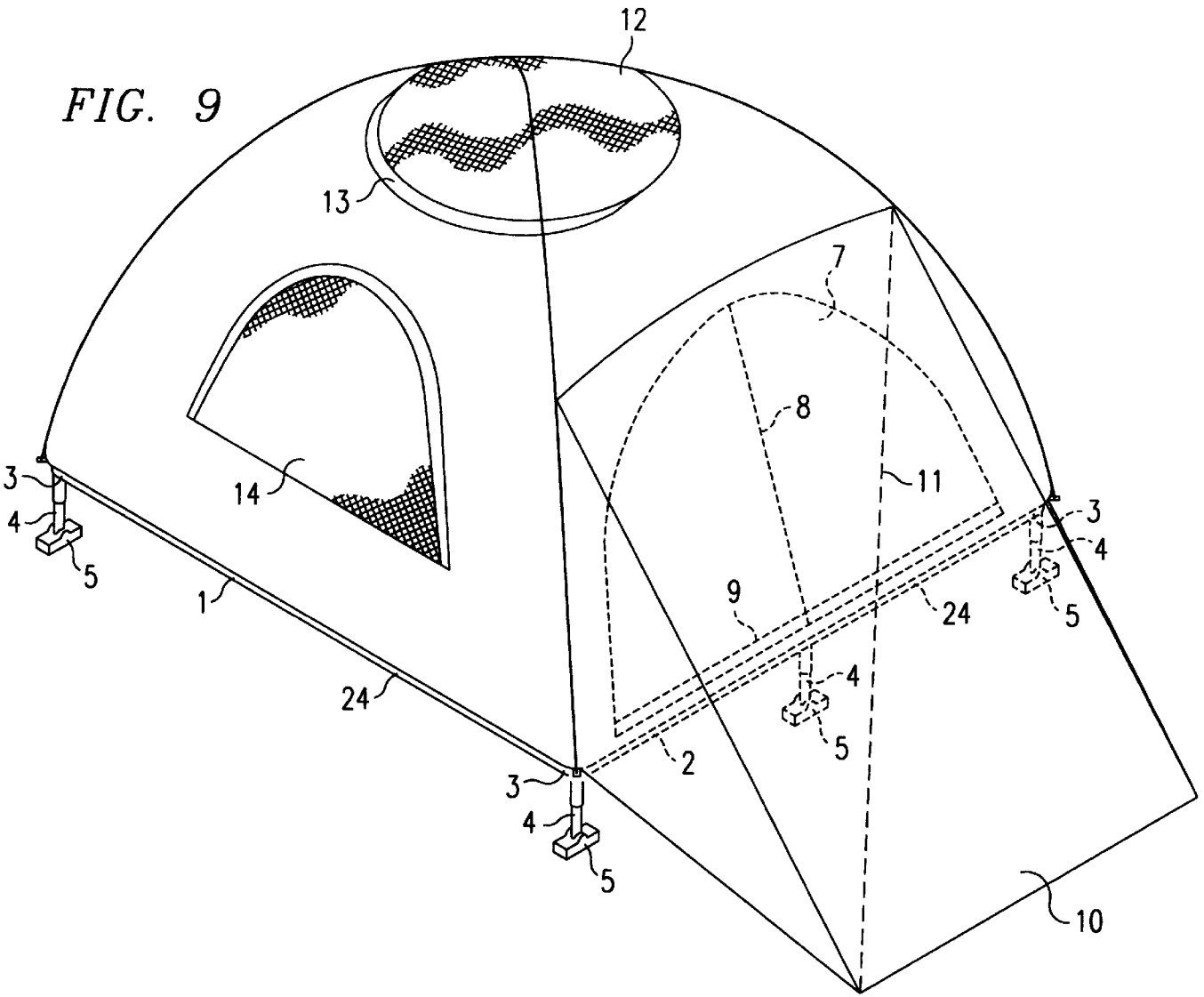
FIG. 9 shows a perspective view of the inventive shelter in a two-user embodiment.

FIG. 9 depicts a perspective view of a two-user embodiment. This two-user embodiment is a substantially similar, but enlarged version of the one-user embodiment. As will be appreciated from FIG. 9, the two-user embodiment has many of the same features as the one-user embodiment. The vestibule enclosure/storage system is expanded under the two-user embodiment in that a rear vestibule 39 and rear entrance 38 may optionally be provided according to FIG. 11. The additional vestibule and entrance, when provided, also allows improved ventilation and access.

Figure 10:
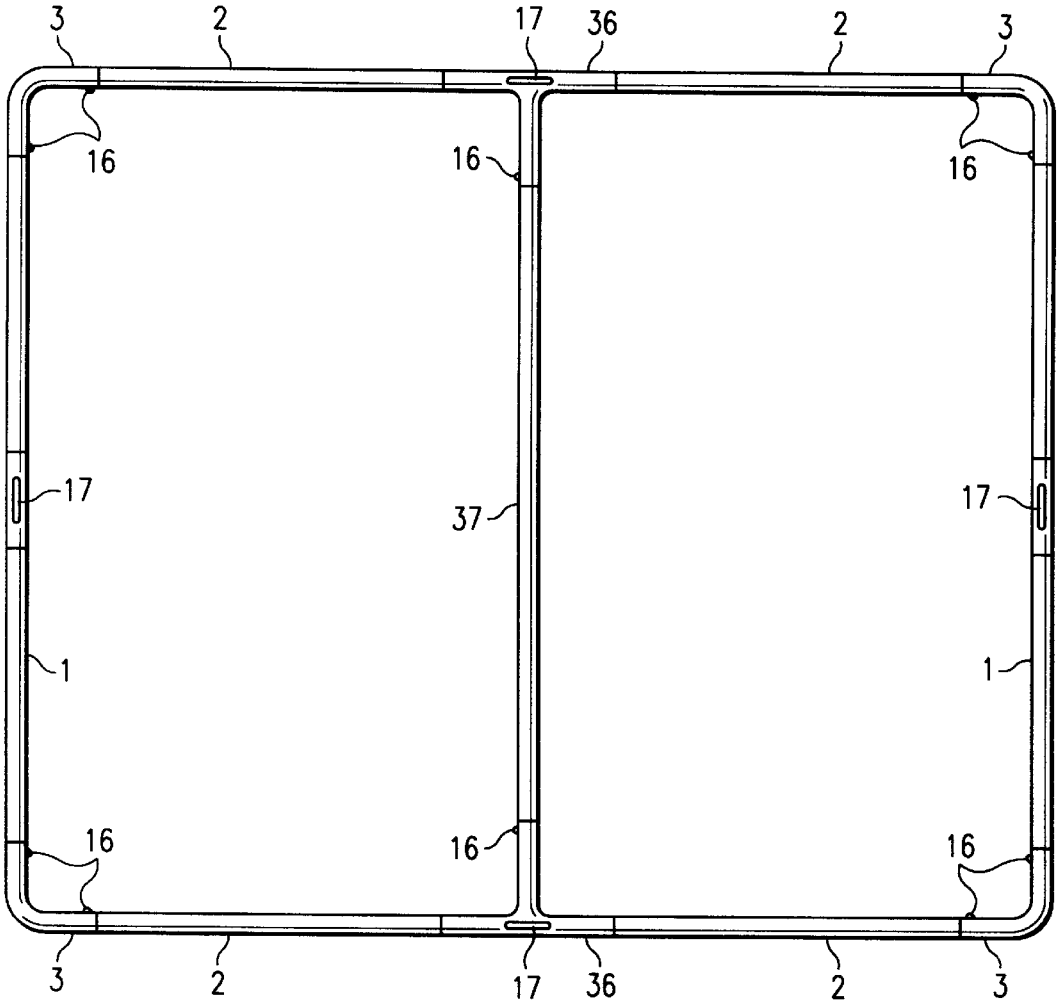
FIG. 10 shows a top view of the collapsible base frame in a two-user embodiment.
Figure 11:
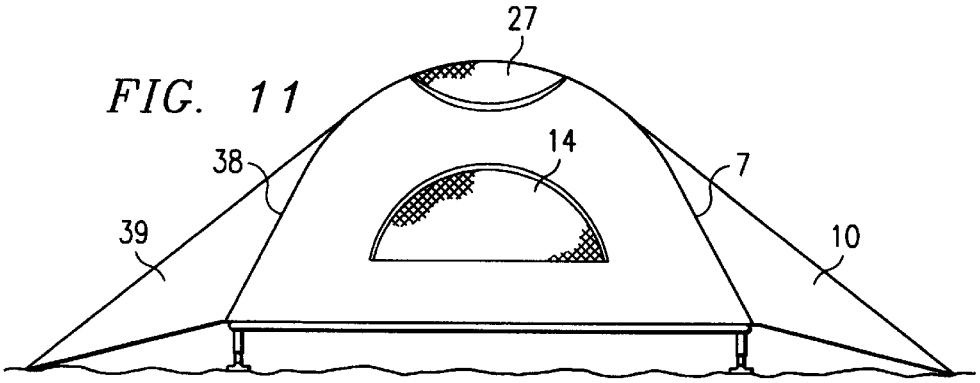
FIG. 11 shows a side view of the front and rear entrances in a two-user embodiment.

Of course, the base frame end components will be likely to be longer in the two-user embodiment. The two-user embodiment also advantageously comprises an additional intermediate set of adjustable height legs to help stabilize the structure. FIG. 10 illustrates the base frame according to a two-user embodiment. Rather than having one extensible end frame piece as in the one-user embodiment, the two-user embodiment advantageously comprises two separate end frame pieces that connect in the center to a proximal "T" bracket 36. The "T" bracket 36 also advantageously contains a further built-in leveling bubble 17. A longitudinal support bar 37 extends horizontally from the proximal "T" bracket 36 and inserts into a distal "T" bracket fitting 36 connecting the opposite end frame components 2. This longitudinal support bar 37 provides additional lateral support to the base frame and further compartmentalizes the floor space.

Although the present invention and its advantages have been described in detail, it should be understood that various changes, substitutions and alterations can be made herein without departing from the spirit and scope of the invention as defined by the appended claims.

I claim:

1. A collapsible all terrain shelter, comprising:

at least three corner brackets;

at least three frame members connectable to the corner brackets, wherein the frame members form a polygonal, substantially planar frame when connected to the corner brackets;

a cloth floor suspendable substantially taut across said substantially planar frame;

at least three of the corner brackets each further having leg linkages;

at least three leg members each connectable to a corresponding leg linkage, wherein the leg members each extend in a common direction orthogonal to the plane of the planar frame when connected to their corresponding leg linkages;

at least three leg adjustment mechanisms each allowing a corresponding leg member to be independently adjusted in length; and a collapsible tent supportable by an assembly comprising (1) the planar frame, (2) the leg members connected to the leg linkages, and (3) the leg adjustment mechanisms each independently adjusted so that the planar frame is substantially level when supported from grade by the leg members.

2. The collapsible all-terrain shelter of claim 1, in which at least one leg member is extensible.

3. The collapsible all-terrain shelter of claim 1, in which the planar frame, when assembled, further comprises a plurality of bubble-level devices, the bubble-level devices interoperable to indicate when the planar frame is substantially level when supported from grade by the leg members.

4. The collapsible all-terrain shelter of claim 1, in which the cloth floor is a multi-ply composite.

5. The collapsible all-terrain shelter of claim 1, in which at least one leg member further provides a hinged stabilizer foot bearing upon grade when the planar frame is supported from grade by the leg members.

6. The collapsible all-terrain shelter of claim 5, in which at least one stabilizer foot provides a non-slip surface bearing upon grade when the planar frame is supported from grade by the leg members.

7. The collapsible all-terrain shelter of claim 1, in which at least one leg adjustment mechanism allows selectable amounts of telescoping.

8. The collapsible all-terrain shelter of claim 1, further comprising a cellar storage sheet, the cellar storage sheet suspendable from the planar frame and beneath the cloth floor when the planar frame is supported from grade.

9. The collapsible all-terrain shelter of claim 1, in which the collapsible tent comprises collapsible hoop arches, the hoop arches extendable and anchorable into grommets in the cloth floor when the cloth floor is suspended substantially taut across the planar frame.

10. The collapsible all-terrain shelter of claim 1, in which at least one frame has a central portion with increased thickness.

11. A collapsible all terrain shelter, comprising:

four corner brackets;

four extensible frame members connectable to the corner brackets, at least one of the frame members having a central portion with increased thickness, wherein the frame members form a quadrilateral, substantially planar frame when extended and connected to the corner brackets;

a multi-ply composite cloth floor suspendable substantially taut across the frame members when connected to form said substantially planar frame;

the corner brackets each further having leg linkages;

four leg members each connectable to a corresponding leg linkage, wherein the leg members each extend in a common direction orthogonal to the plane of the planar frame when connected to their corresponding leg linkages;

four telescoping leg adjustment mechanisms each allowing a corresponding leg member to be independently adjusted in length;

a collapsible tent supportable by an assembly comprising (1) the planar frame, (2) the leg members connected to the leg linkages, and (3) the leg adjustment mechanisms each independently adjusted so that the planar frame is substantially level when supported from grade by the leg members;

a plurality of bubble-level devices on the planar frame, the bubble-level devices interoperable to indicate when the planar frame is substantially level when supported from grade by the leg members;

each leg member further providing a hinged stabilizer foot, the stabilizer feet each bearing upon grade with a non-slip surface when the planar frame is supported from grade by the leg members; and a cellar storage sheet, the cellar storage sheet suspendable from the planar frame and beneath the cloth floor when the planar frame is supported from grade.

12. The collapsible all-terrain shelter of claim 11, in which the collapsible tent comprises collapsible hoop arches, the hoop arches extendable and anchorable into grommets in the cloth floor when the cloth floor is suspended substantially taut across the planar frame.

13. A collapsible all-terrain shelter, comprising:

four corner brackets and two intermediate brackets;

seven frame members connectable from the corner brackets and the intermediate brackets, wherein the frame members form a quadrilaterally-shaped, substantially planar frame when connected to the corner brackets and the intermediate brackets such that (1) first and second frame members each connect a first intermediate bracket to first and second corner brackets respectively, (2) third and fourth frame members each connect a second intermediate bracket to third and fourth corner brackets respectively, (3) a fifth frame member connects first and third corner brackets, (4) a sixth member connects second and fourth corner brackets, and (5) a seventh member connects first and second intermediate brackets;

a cloth floor suspendable substantially taut across the frame members when connected to form said substantially planar frame;

the corner brackets and the intermediate brackets each further having leg linkages;

six leg members each connectable to a corresponding leg linkage, wherein the leg members each extend in a common direction orthogonal to the plane of the planar frame when connected to their corresponding leg linkages;

six leg adjustment mechanisms each allowing a corresponding leg member to be independently adjusted in length;

a collapsible tent supportable by an assembly comprising (1) the planar frame, (2) the leg members connected to the leg linkages, and (3) the leg adjustment mechanisms each independently adjusted so that the planar frame is substantially level when supported from grade by the leg members.

14. The collapsible all-terrain shelter of claim 13, in which at least one leg member is extensible.

15. The collapsible all-terrain shelter of claim 13, in which the planar frame, when assembled, further comprises a plurality of bubble-level devices, the bubble-level devices interoperable to indicate when the substantially planar frame is level when supported from grade by the leg members.

16. The collapsible all-terrain shelter of claim 13, in which the cloth floor is a multi-ply composite.

17. The collapsible all-terrain shelter of claim 13, in which at least one leg member further provides a hinged stabilizer foot bearing upon grade when the planar frame is supported from grade by the leg members.

18. The collapsible all-terrain shelter of claim 17, in which at least one stabilizer foot provides a non-slip surface bearing upon grade when the planar frame is supported from grade by the leg members.

19. The collapsible all-terrain shelter of claim 13, in which at least one leg adjustment mechanism allows selectable amounts of telescoping.

20. The collapsible all-terrain shelter of claim 13, further comprising a cellar storage sheet, the cellar storage sheet suspendable from the planar frame and beneath the cloth floor when the planar frame is supported from grade.

21. The collapsible all-terrain shelter of claim 13, in which the collapsible tent comprises collapsible hoop arches, the hoop arches extendable and anchorable into grommets in the cloth floor when the cloth floor is suspended substantially taut across the planar frame.

22. The collapsible all-terrain shelter of claim 13, in which at least one frame member has a central portion with increased thickness.

* * * * *